US006467887B2

(12) United States Patent
Lopez et al.

(10) Patent No.: US 6,467,887 B2
(45) Date of Patent: Oct. 22, 2002

(54) PIEZOELECTRIC INK JET PRINTING SYSTEM

(75) Inventors: Juan E. Lopez, St. Louis, MO (US); Scott A. Bruckerhoff, Wentzville, MO (US); Clifford R. Cairatti, Belleville, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 09/843,120

(22) Filed: Apr. 27, 2001

(65) Prior Publication Data

US 2001/0015741 A1 Aug. 23, 2001

Related U.S. Application Data

(62) Division of application No. 09/258,459, filed on Feb. 26, 1999, now Pat. No. 6,227,659, which is a division of application No. 08/618,981, filed on Mar. 20, 1996, now Pat. No. 5,917,508.

(51) Int. Cl.[7] ..... B41J 2/045

(52) U.S. Cl. ..... 347/68; 347/85; 347/84; 347/108

(58) Field of Search ..... 347/68, 85, 108, 347/84, 87, 66, 89

(56) References Cited

U.S. PATENT DOCUMENTS

| | | | | |
|---|---|---|---|---|
| 3,761,953 | A | 9/1973 | Helgeson et al. | 347/7 |
| 3,911,818 | A | 10/1975 | MacIlvaine | 101/494 |
| 4,067,020 | A | 1/1978 | Arway | 347/7 |
| 4,178,595 | A | 12/1979 | Jinnai et al. | 347/7 |
| 4,223,323 | A | 9/1980 | Bader et al. | 347/85 |
| 4,342,042 | A | 7/1982 | Cruz-Uribe et al. | 347/7 |
| 4,399,446 | A | 8/1983 | McCann et al. | 347/89 |
| 4,462,037 | A | 7/1984 | Bangs et al. | 347/85 |
| 4,536,776 | A | 8/1985 | Knirsch et al. | 347/55 |
| 4,677,448 | A | 6/1987 | Mizusawa et al. | 347/85 |
| 4,694,307 | A | 9/1987 | Toganoh et al. | 347/85 |
| 4,714,934 | A | 12/1987 | Rogers | 347/107 |
| 4,734,711 | A | 3/1988 | Piatt et al. | 347/17 |
| 5,101,224 | A | 3/1992 | Freed, Jr. | 347/4 |
| 5,900,890 | A | 5/1999 | Mitchell | 347/28 |
| 5,917,508 | A | 6/1999 | Lopez et al. | 347/4 |

*Primary Examiner*—Lamson Nguyen
(74) *Attorney, Agent, or Firm*—Lisa M. Soltis; Mark W. Croll; Donald J. Broh

(57) ABSTRACT

A piezoelectric ink jet printing system including a primary ink supply and a plurality of piezoelectric ink jet printhead assemblies. Each assembly comprises a housing, a piezoelectric ink jet printhead in the housing, a secondary ink supply attached to the housing adjacent the printhead, and an ink supply line for delivery of ink from the secondary ink supply to the printhead. The system further includes a pump for pumping ink from the primary ink supply to the secondary ink supply of each printhead assembly. Each printhead assembly is operable independently of the other printhead assemblies and are selectively movable with respect to the other printhead assemblies and with respect to the primary ink supply so that each printhead assembly can be positioned at a desired location without regard to where the other printhead assemblies are to be positioned and without regard to where the primary ink supply is positioned.

3 Claims, 8 Drawing Sheets

PIEZOELECTRIC INK JET PRINTING SYSTEM

CROSS-REFERENCE TO RELATED APPLICATIONS

This case is a divisional of U.S. Ser. No. 09/258,459, entitled "PIEZOELECTRIC INK JET PRINTING SYSTEM", filed Feb. 26, 1999, now U.S. Pat. No. 6,227,659 which is a divisional of U.S. Ser. No. 08/618,981, entitled "PIEZOELECTRIC INK JET PRINTING SYSTEM" filed Mar. 20, 1996 now U.S. Pat. No. 5,917,508.

BACKGROUND OF THE INVENTION

This invention relates generally to ink jet printing systems, and more particularly to piezoelectric ink jet printing systems.

A piezoelectric ink jet printhead is susceptible to problems when suddenly jarred. This is because the piezoelectric components of the printhead effect the delivery of ink to the orifices of the printhead at extremely low pressures. As a result, when the printhead is subjected to vibration or impact, the flow of ink through passages in the printhead and related supply lines may be interrupted, causing undesirable discontinuities in the supply of ink to the ink orifices and often necessitating "repriming" of the printhead. This problem is magnified when the line from the ink supply to the printhead is relatively long because there is a greater likelihood that vibration-induced shock moving through the line will disrupt the flow of ink. Previously, ink jet systems have used relatively small ink reservoirs located close to the printhead to reduce the length of the supply line. However, due to its small capacity, the reservoir must be refilled manually or replaced, at frequent intervals, which is inconvenient and increases downtime of the system.

SUMMARY OF THE INVENTION

Among the several objects of this invention may be noted the provision of an ink jet printing system having multiple printheads which can be independently located with respect to each other and with respect to a primary ink supply to allow greater flexibility in the use and application of the system; the provision of such a system which has multiple printhead assemblies each containing a secondary ink supply located adjacent to the printhead to reduce the length of an ink supply line, thus minimizing interruptions in ink flow due to vibration; the provision of such a system wherein the printhead and a secondary ink supply reservoir are contained within the same housing, and wherein the supply reservoir is adjustable to maintain a constant orientation for proper system operation when the printhead is rotated to print different size indicia; the provision of such a system which provides automatic refilling of a secondary ink supply to eliminate the need for frequent manual refilling; and the provision of such a system which includes a purge system for purging individual printheads and supply lines without overfilling the secondary ink supply.

Briefly, a piezoelectric ink jet printing system of this invention includes a primary ink supply and a plurality of piezoelectric ink jet printhead assemblies. Each assembly comprises a housing, a piezoelectric ink jet printhead in the housing, a secondary ink supply attached to the housing adjacent to the printhead, and an ink supply line for delivery of ink from the secondary ink supply to the printhead. The system further includes a pump for pumping ink from the primary ink supply to the secondary ink supply of each printhead assembly. Each printhead assembly is operable independently of the other printhead assemblies and is selectively movable with respect to the other printhead assemblies and with respect to the primary ink supply so that each printhead assembly can be positioned at a desired location without regard to where the other printhead assemblies are to be positioned and without regard to where the primary ink supply is positioned.

In a second aspect of this invention, the ink jet printing system includes a primary ink supply and a plurality of piezoelectric ink jet printhead assemblies. Each assembly includes a housing, a piezoelectric ink jet printhead in the housing, a secondary ink supply attached to the housing adjacent to the printhead, and an ink supply line for delivery of ink from the secondary ink supply to the printhead. The printhead of each printhead assembly includes a linear array of ink orifices through which ink is ejected to print indicia on a surface. Each printhead assembly further comprises a device for mounting the housing and printhead therein for rotation about a first axis extending generally perpendicular to the surface thereby to vary the height of the indicia printed on the surface by the printhead in the housing, and a device for locking the housing in a selected position of rotational adjustment according to the desired height of indicia to be printed. The secondary ink supply of each printhead assembly is rotatably mounted with respect to the housing of the assembly so that when the housing of the printhead assembly is rotated in one direction about said first axis, the secondary ink supply may be rotated in an opposite direction to maintain the secondary ink supply in a selected predetermined attitude.

In a third aspect of this invention the system comprises a primary ink supply and a plurality of piezoelectric ink jet printhead assemblies. Each assembly comprises a piezoelectric ink jet printhead, a secondary ink supply adjacent to the printhead, and an ink supply line for delivery of ink form the secondary ink supply to the printhead. The system further comprises a pump for pumping ink from the primary ink supply to the secondary ink supply of each printhead assembly and a purge system for each printhead assembly for delivering ink under pressure from the primary ink supply to the printhead of the assembly thereby to purge air from the printhead. The purge system comprises a purge line which bypasses the secondary ink supply of the printhead assembly to prevent the delivery of ink under pressure to the secondary ink supply during purging of the printhead.

Other objects and features will be in part apparent and in part pointed out hereinafter.

BRIEF DESCRIPTION OF THE DRAWINGS

Corresponding parts are designated by corresponding reference numerals in the several views of the drawings.

DESCRIPTION OF PREFERRED EMBODIMENTS

Figure 1:
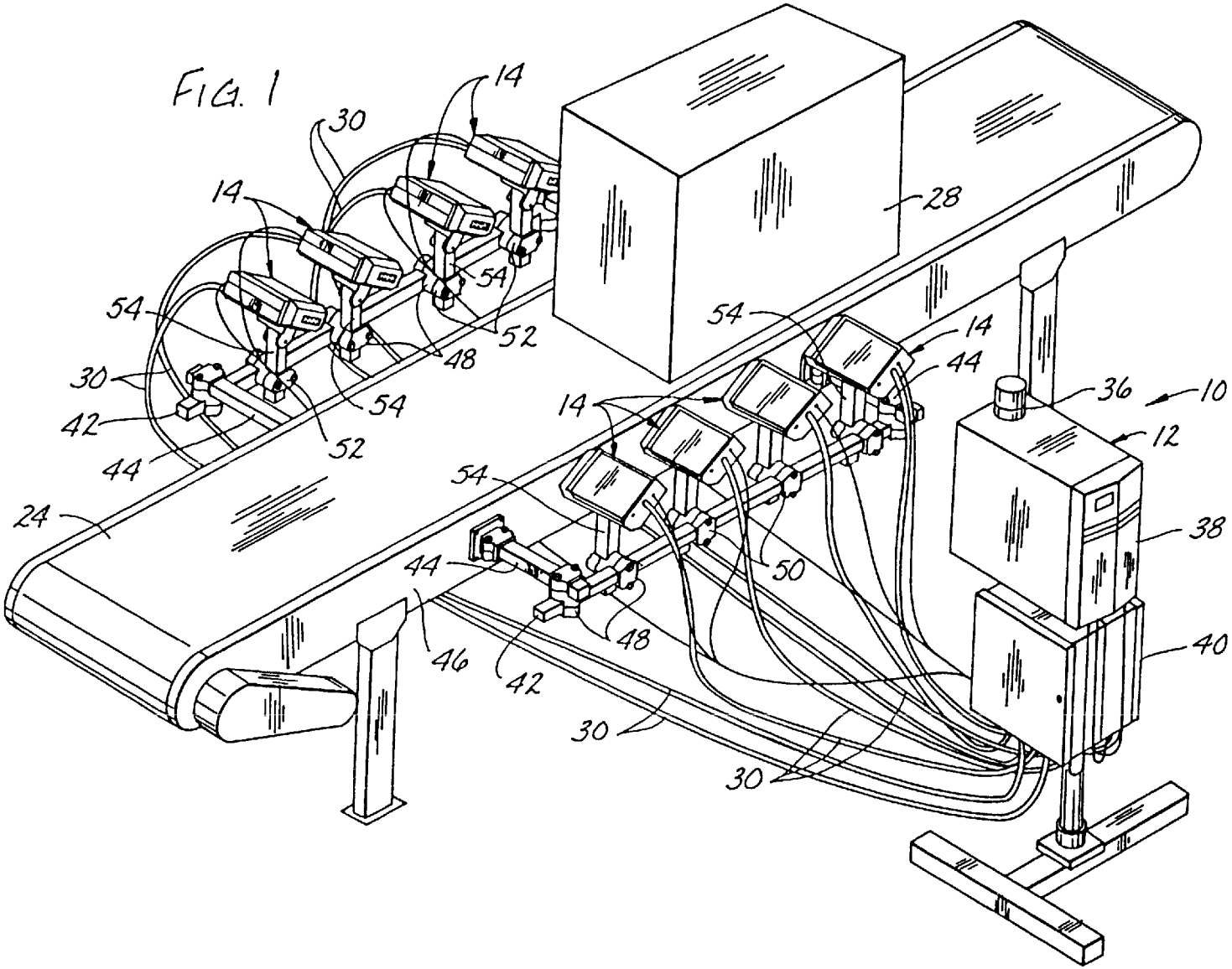
FIG. 1 is a perspective view of a piezoelectric ink jet printing system of the present invention.
Figure 2:
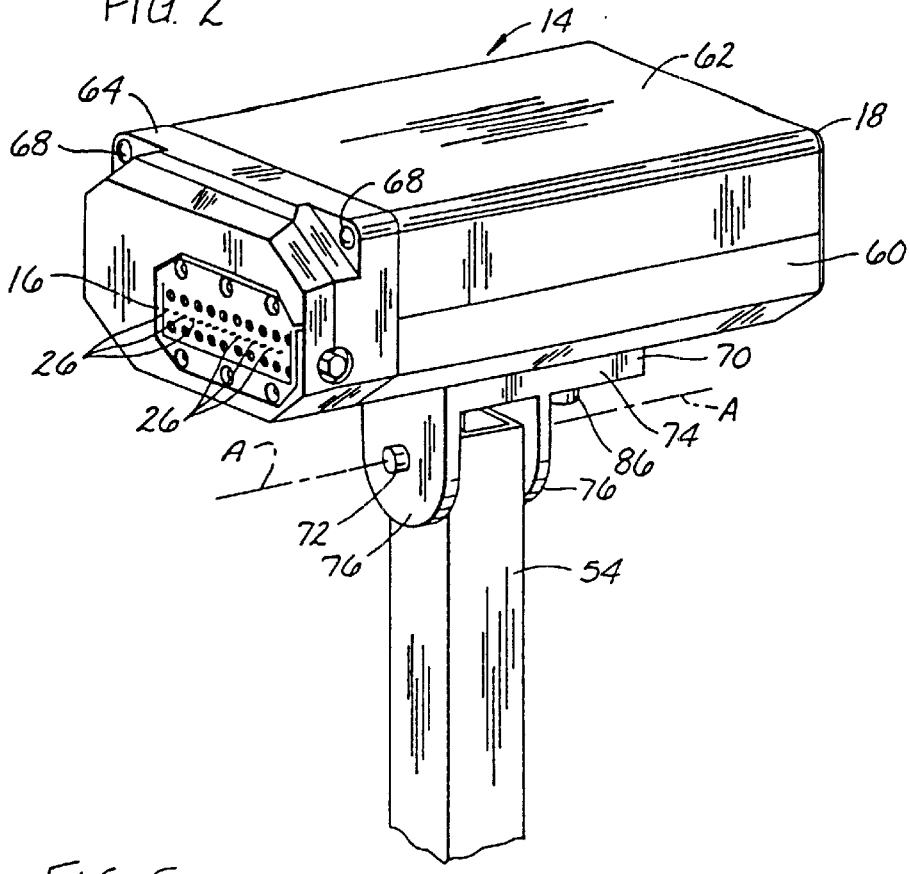
FIG. 2 is a perspective view of a printhead assembly of the ink jet printing system of FIG. 1.
Figure 3:
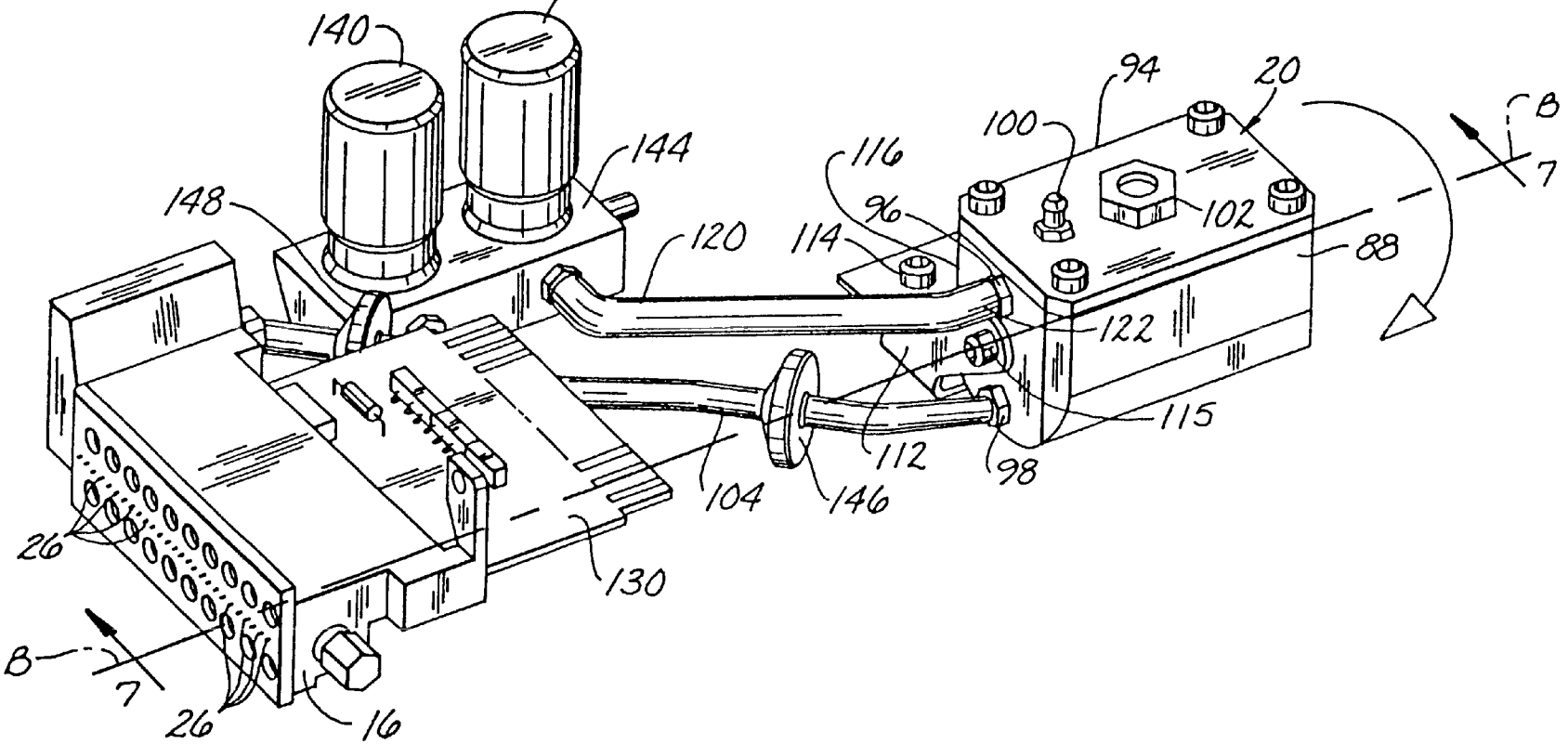
FIG. 3 is a perspective view of components of the printhead assembly of FIG. 2.
Figure 6:
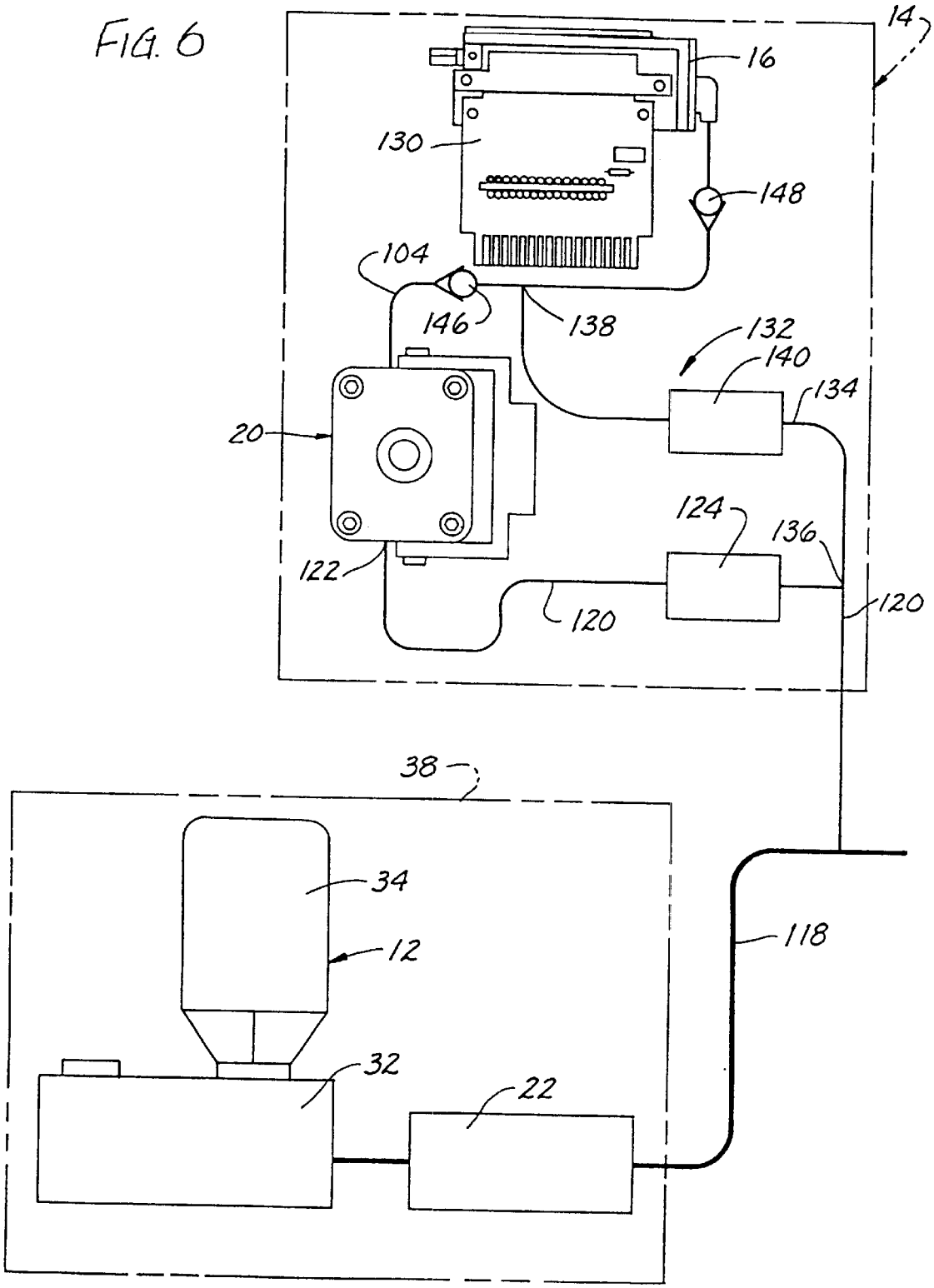
FIG. 6 is a hydraulic schematic of the ink jet printing system of FIG. 1.

Referring now to the drawings, and first to FIGS. 1–3, a piezoelectric ink jet printing system is generally indicated at 10. The system comprises a primary ink supply, generally designated 12, and a plurality of piezoelectric ink jet printhead assemblies 14, each of which includes a printhead 16 and a housing 18 for both the printhead and a secondary ink supply 20. As shown in FIG. 6, a pump 22 is provided for pumping ink from the primary ink supply 12 to the secondary ink supply 20 of each printhead assembly 14. The printheads 16 may be any suitable piezoelectric printhead, such as a printhead available from Trident, Inc. of Brookfield, Conn., in which the ejection of ink droplets through multiple nozzles is effected by the reciprocation of plungers driven by piezoelectricity. U.S. Pat. No. 4,714,934, incorporated herein by reference, describes such a printhead.

The printhead assemblies 14 are typically arranged on opposite sides of a conveyor 24. The printhead 16 of each assembly 14 has a linear array of ink orifices 26 (FIGS. 2 and 3) through which ink is ejected to print indicia on a surface 28 such as the side of a carton or other product travelling along the conveyor 24. The printhead assemblies 14 may be mounted in various configurations and any number of printhead assemblies may be used. The primary ink supply 12 is preferably located in the general vicinity (e.g., 40 feet) of the printhead assemblies 14 to reduce the length of ink supply lines 30 and associated pressure drop. As shown in FIG. 6, the primary ink supply 12 preferably includes a reservoir 32 and a large ink supply bottle 34 (1 liter or 500 ml for example) having an opening (not shown) connected to the reservoir. The reservoir 32 includes a level detector (not shown) which senses when the ink bottle 34 is empty and sends a signal to a low level light 36 (FIG. 1) to notify someone to replace the ink supply bottle. In addition to illuminating the low level light 36, the level detector also sends a signal to shut off the pump 22 so that the reservoir 32 is not completely emptied of ink. This prevents possible damage to the pump 22 from running without ink and allows for replacement of the ink bottle 34 without interruption of operation of the printheads 16. The ink bottle 34, reservoir 32 and pump 22 are all located within a single enclosure 38 adjacent to an electronic controller 40 (FIG. 1) which controls the operation of the system 10. It is to be understood that other pump, reservoir and controller arrangements may be used without departing from the scope of this invention.

Each printhead assembly 14 is operable independently of the other printhead assemblies and is selectively moveable with respect to the other printhead assemblies and with respect to the primary ink supply 12 so that each printhead assembly can be positioned at a desired location without regard to where the other printhead assemblies are to be positioned and without regard to where the primary ink supply is positioned. A typical arrangement of printhead assemblies 14, primary ink supply 12 and conveyor 24 is shown in FIG. 1. Two mounting bars, each designated 42, are located on opposite sides of the conveyor 24 and extend generally parallel to the conveyor for mounting the printhead assemblies 14 along the conveyor. Each mounting bar 42 is attached to a respective side of the conveyor 24 by two arms 44 extending out from the conveyer frame 46. Clamps 48 are provided to connect the printhead assemblies 14 to the bar 42 at selected locations along the bar. Each clamp 48 includes a first part 50 which clamps onto the bar 42 and a second part 52 which slidably receives the lower end of a support post 54 connected at its upper end to a respective printhead assembly 14. The elevation of each printhead assembly 14 may be adjusted by loosening the second part 52 of the clamp 48, slidably moving the support post 54 vertically within the clamp to the desired elevation, and then tightening the second part of the clamp. The position of the printhead assembly 14 is also adjustable in a direction parallel to the conveyor 24 by loosening the first part 50 of the clamp 48, sliding the clamp and associated printhead assembly 14 along the mounting bar 42, and tightening the first part of the clamp.

Figure 5:
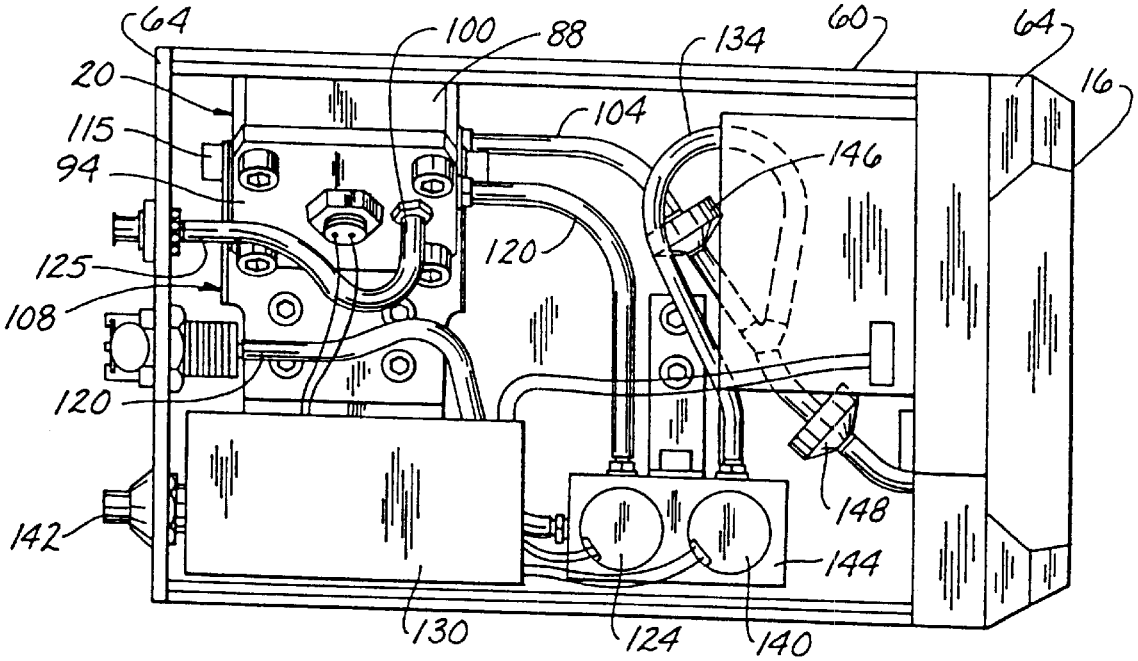
FIG. 5 is a plan view of the printhead assembly of FIG. 2 with an upper part of the housing removed.
Figure 4:
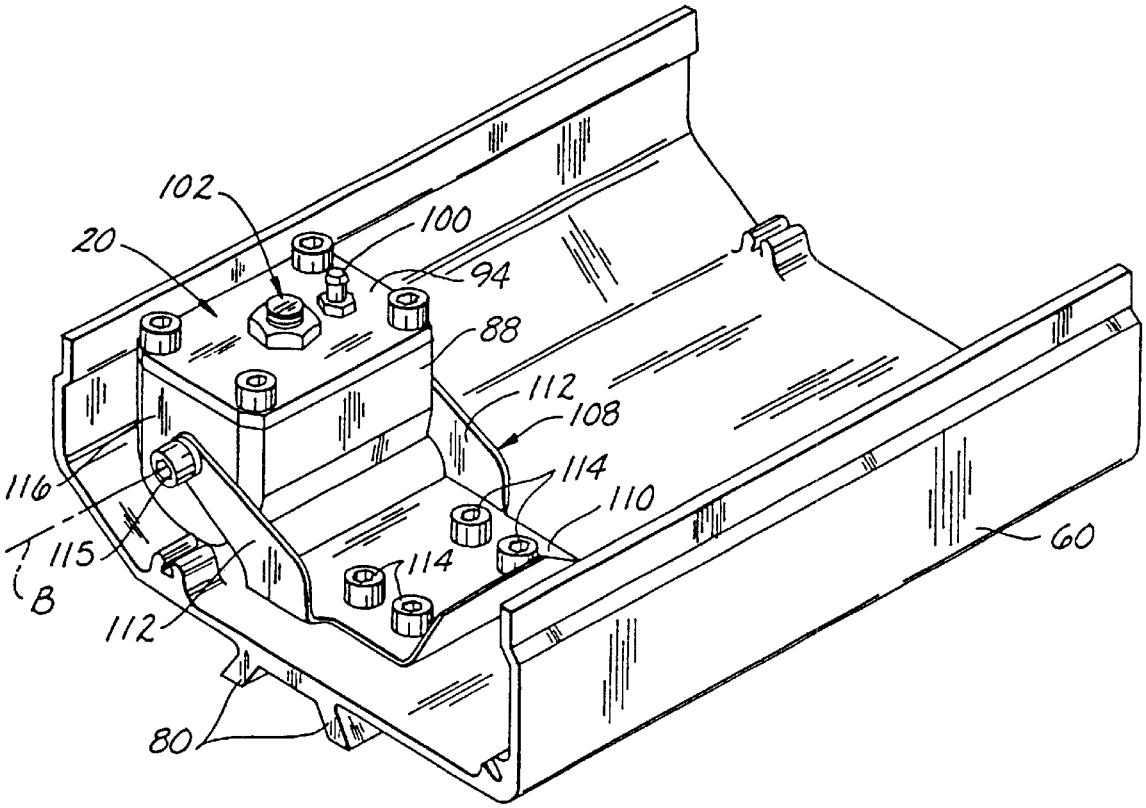
FIG. 4 is a perspective view of a secondary ink supply mounted within a lower part of a housing of the printhead assembly of FIG. 2.

It will be observed from FIG. 2 that the printhead housing 18 includes a lower part 60, an upper part 62 and a pair of end caps 64. The upper part 62 is releasably attached to the lower part 60 and the end caps 64 are attached to the lower and upper parts by screws 68 or any other suitable fasteners. To remove the upper part 62 of the housing 60, two upper screws 68 must be removed from each end cap 64. The upper part 62 may be removed from the printhead assembly 14 without removing the end caps 64. As shown in FIGS. 4 and 5, components within the housing 18 are secured to the lower part 60 of the housing 18.

Figure 2A:
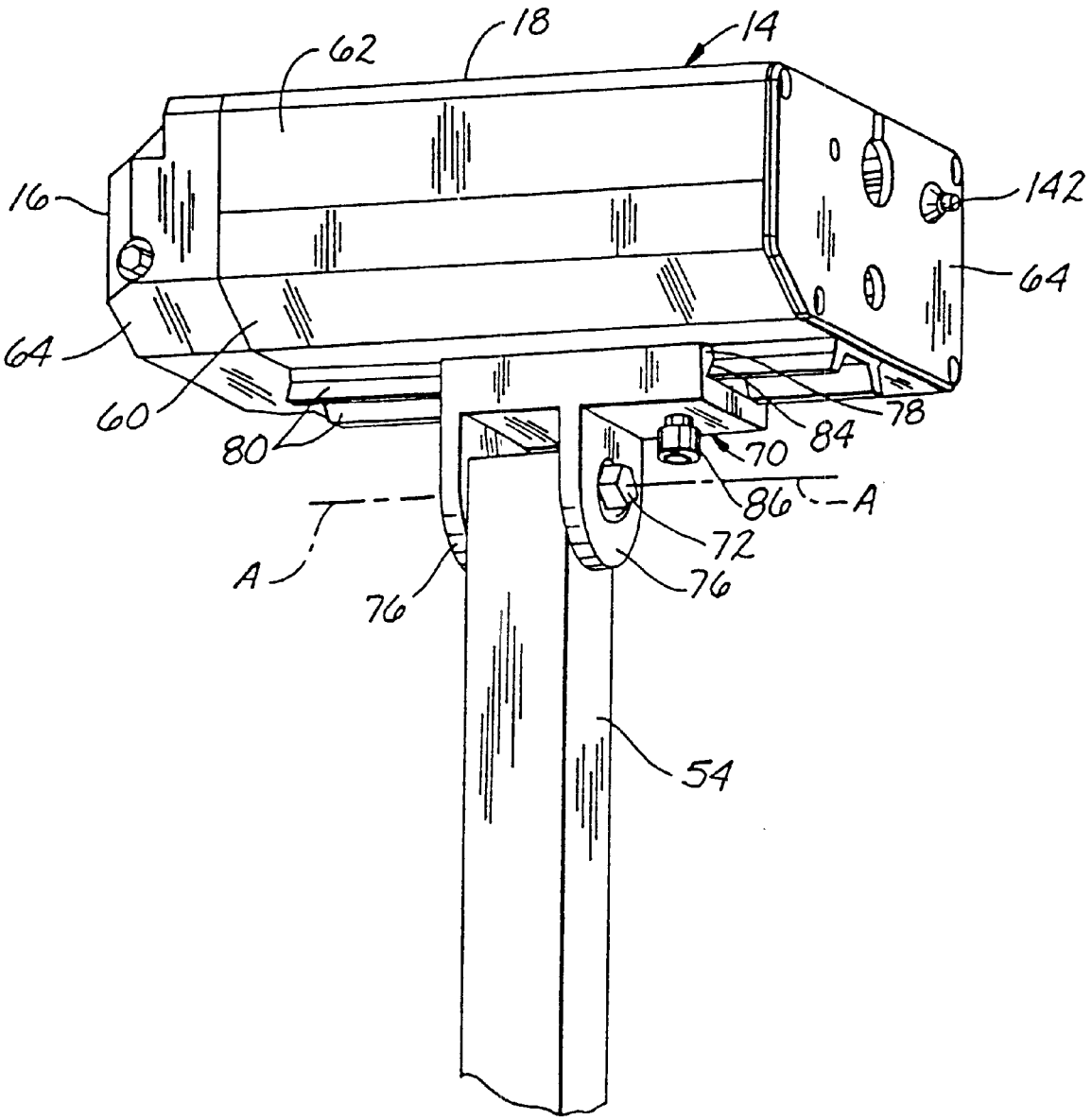
FIG. 2A is a rear perspective view of the printhead assembly of FIG. 2.

As shown best in FIG. 2A, a bracket 70 is used to mount the housing 18 of each printhead assembly 14 on its respective support post 54 for rotation of the assembly about a first axis A generally perpendicular to the surface 28 upon which indicia is to be printed. This rotation allows an operator to match the incline or decline of the conveyor 24, or to vary the height of the indicia to be printed on surface 28, since rotation of the assembly changes the angular position (and thus the effective printing height) of the linear array of printhead orifices. A fastener 72 is provided for locking the housing 18 in a selected position of rotational adjustment according to the desired height of indicia to be printed. The bracket 70 includes a base 74 and two legs 76 extending down from the base on opposite sides of the upper end of the support post 54. The fastener 72 extends through holes in both legs 76 and the support post 54. A clamp-up bushing (not shown) is provided between one of the legs 76 and the support post 54 to hold the printhead assembly in a set angular position when the fastener 72 is tightened.

The position of the printhead assembly 14 can be adjusted in a direction generally perpendicular to the conveyor 24 by sliding the housing 18 of the assembly relative to the bracket 70. It will be noted in this regard that the base 74 of the bracket 70 is generally U-shaped and forms a channel 78 having an open top for receiving two parallel ribs 80 projecting along a lower surface of housing (see FIG. 2A). The two ribs are spaced apart a distance such that they have a close sliding fit within the channel 78, thus enabling adjustment of the printhead assembly 14 relative to the bracket 70. The ribs 80 are preferably angled outward and the sides 84 of the channel 78 are preferably angled inward to form a dovetail sliding connection which prevents movement of the housing 18 in a vertical direction relative to the bracket 70. A set screw 86 holds the printhead assembly 14 in a set linear position. It is to be understood that other mounting and adjustment configurations may be used without departing from the scope of this invention.

The secondary ink supply 20 inside the housing comprises a small receptacle 88 defining a reservoir 92 for the ink supply, a removable top 94 fastened to the receptacle, an inlet 96, an outlet 98, a vent 100 and a level detector generally designated 102. A short ink supply line 104 connects the outlet 98 to the printhead 16. The secondary ink supply 20 is attached to the lower part 60 of the housing 18 close to the printhead 16 to minimize the length of 104. The secondary ink supply 20 is rotatably mounted with respect to the housing 18 so that when the housing is rotated in one direction about axis A, the reservoir 92 of the secondary ink supply may be rotated in an opposite direction about a second axis B to maintain the reservoir in a selected predetermined attitude, usually one in which the top 94 of the reservoir is horizontal and level. In the preferred embodiment, axis B passes through or closely adjacent to the lowest ink orifice 106 in the linear array of orifices 26 of the printhead 16 (FIG. 3). The arrangement is such as to maintain the fluid level in the reservoir at a height sufficient to provide flow from the outlet 98 of the reservoir to the printhead without causing weepage of ink from the orifices 26 when the printhead is not printing due to head pressure in the reservoir 92.

Figure 7:
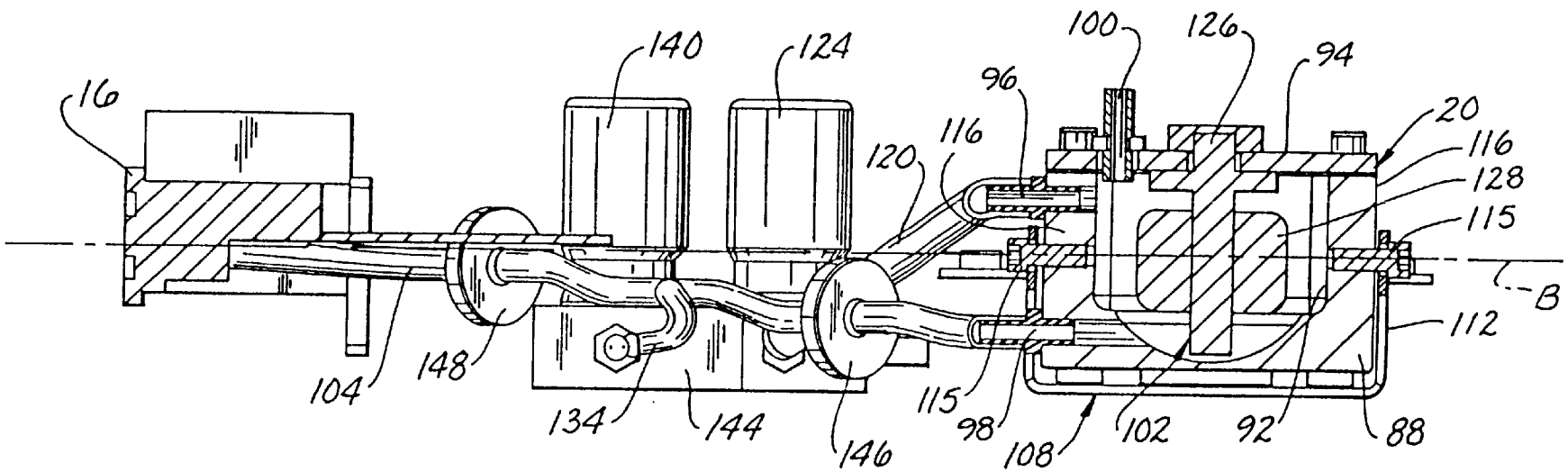
FIG. 7 is a cross-sectional view taken along line 7—7 of FIG. 3.
Figure 8:
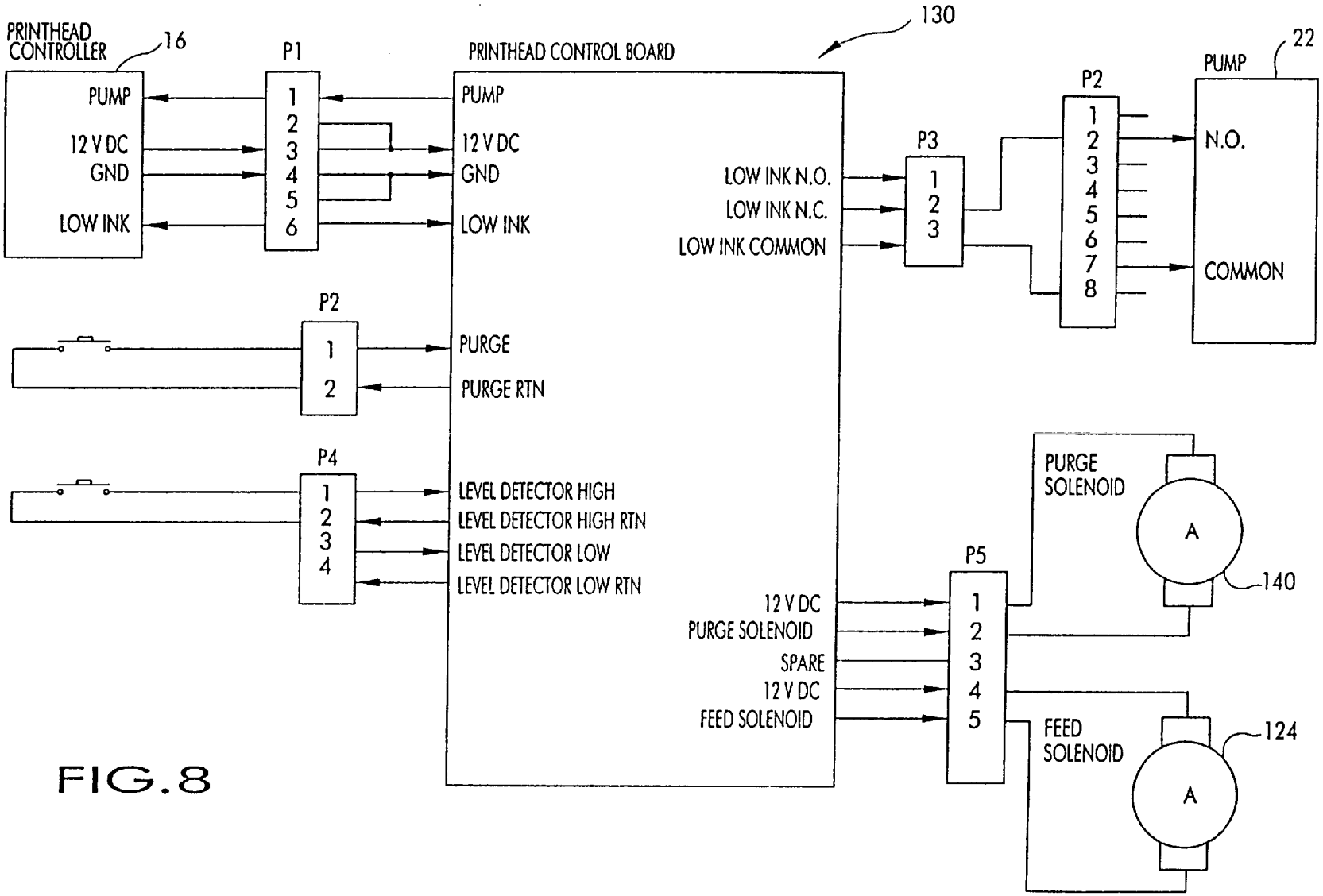
FIG. 8 is an electrical schematic of a printhead controller of the printhead assembly.

As shown in FIGS. 3, 4 and 7, the receptacle 88 of the secondary ink supply 20 is rotatably carried by a leveling bracket 108 so that the reservoir 92 can be rotated to accommodate the angle at which the housing and printhead 16 oriented. The secondary ink supply 20 is preferably rotated so that the top 94 of the reservoir 92 is maintained in a horizontal and level position to allow for proper operation of the level detector 102. The leveling bracket 108 comprises a base 110 and two arms 112 angling up from the base. The base 110 of the bracket 108 is attached to the lower part 60 of the housing 18 by four screws 114. Each arm 112 has a hole at its upper end for receiving a screw 115 having a major diameter slightly smaller than the diameter of the hole. The arms 112 are sized and spaced for receiving the receptacle 88 of the secondary ink supply 20 therebetween. The holes in the arms 112 are aligned with openings located in opposite side walls 116 of the receptacle (FIG. 7). These openings extend only partially through the walls 116 of the receptacle 88 and do not extend into the reservoir 92 of the secondary ink supply 20. Screws 115 extend through the holes in the arms 112 of the leveling bracket 108 and are threaded into the openings in the receptacle 88. The screws 114 are tightened sufficient to frictionally hold the receptacle 88 in a set position while still permitting manual rotation of the receptacle about axis B without loosening the screws. In order to adjust the attitude of the receptacle 88 following adjustment of the printhead assembly 14 about axis A, the upper part 62 of the housing 18 is removed and the receptacle is manually rotated about axis B so that the top 94 of reservoir 92 remains in a horizontal and level position. Means other than that shown in the drawings and described above may be provided for mounting the receptacle 88 for rotation on axis B.

As illustrated in FIG. 6, the pump 22 supplies ink to each printhead assembly via a main ink supply line 118 and a plurality of ink feed lines 120 which branch from the main line and feed ink to the individual printhead assemblies 14. The downstream end 122 of each feed line 120 is connected to the inlet 96 of the secondary ink supply 20 of a respective printhead assembly 14. A normally closed feed valve 124 mounted in the housing 18 of the printhead assembly 14 controls flow of ink through the feed line 120 to the reservoir 92 of the secondary ink supply 20. The feed valve 124 is moveable from its normally closed position in which flow of ink into the secondary ink supply 20 is blocked, to an open position allowing flow to the secondary ink supply. The feed valve 124 is an electronically controlled, two-position solenoid valve that responds to a signal received from the level detector 102 located within the reservoir 92. The solenoid valve may be of conventional design, one such valve being commercially available from Angar Scientific under trade designation AM195.

As shown in FIG. 7, the level detector 102 comprises a magnetic float 126 and a reed switch 128. The reed switch 128 may be any suitable design, such as one commercially available from National Magnetic under trade designation TLS-10NPS. The reed switch 128 is actuated when the ink in the reservoir 92 reaches a low level (switch open) and, during filling, when the ink in the reservoir reaches a full level (switch closed). The low level is preferably about 0.125 in. below the elevation of the lowest orifice 26 of the printhead, and the full level is preferably about 0.125 in above the elevation of the lowest orifice of the printhead, the arrangement being such that the level of ink in the reservoir is not so high as to cause weeping through the orifices and not so low as to risk interruption of the ink supply to the printhead. Upon actuation of the reed switch 128 by a low level condition, a signal is sent to an electronic printhead controller 130 (FIGS. 5 and 6), contained within the housing 18 of the printhead assembly 14, and after a one minute delay, the controller sends a signal to turn on the pump 22 and open the feed valve 124, thus allowing pressurized ink supplied from the ink feed line 120 to flow into the reservoir 92 of the secondary ink supply 20. The feed valve 124 remains open until the magnetic float 126 reaches its full position at which time the reed switch 128 is actuated to send a signal to the printhead controller 130 to shut off the pump 22 and close the feed valve 124. The one minute delay is provided to extend pump life by reducing the number of on/off cycles due to transient flow. The secondary ink supply 20 further includes a vent line 125 to prevent overpressurization of the secondary ink supply reservoir 92 in case the reservoir is inadvertently overfilled due to a failure in the electronics or to a feed valve 124 which does not properly close.

It will be understood from the foregoing that the level detector 102 and printhead controller 130 constitute a system for effecting operation of the pump 22 to deliver ink from the primary ink supply 12 to the secondary ink supply 20 of the printhead assembly 14 in response to a decrease in the quantity of ink in the secondary ink supply 20 thereby automatically to refill the secondary ink supply.

In accordance with this invention, each printhead assembly 14 has a purge system, generally indicated at 132 (FIG. 6), associated with it for delivering ink under pressure from the primary ink supply 12 to the printhead 16 of the assembly thereby to purge air from the printhead. This system 132 includes a purge line 134 connected at its upstream end 136 to the feed line 120 for the printhead assembly 14 and at its downstream end 138 to the short ink supply line 104, and a normally closed purge shutoff valve 140 in the housing 18 of the printhead assembly for controlling the flow of ink through the purge line. The purge line 134 bypasses the secondary ink supply 20 to prevent the delivery of ink under pressure to the secondary ink supply during a purge cycle. The shutoff valve 140 is similar to the feed solenoid valve 104 and is movable between a closed position for blocking flow through the purge line 134 and an open position permitting flow through the line to deliver ink to the printhead 16 in a quantity sufficient to force ink through the printhead to purge air from the printhead. The purge operation is also effective for purging the short ink supply line 104 downstream of its juncture with the purge line 134. Purging of the printhead 16 is accomplished by pushing a purge manually operated switch 142 (FIG. 2A) located on the housing 18 of the printhead assembly 14. Actuation of this switch 142 signals the printhead controller 130 to turn on the pump 22 and to open the purge valve 140, thereby causing ink to be delivered under pressure to the printhead 16. The purge switch 142 may be manually operated or it may be electronically controlled to operate automatically upon start-up and/or at specified intervals of time, for example.

Both the feed valve 124 and purge valve 140 may be solenoid operated, in which case the solenoids may be attached to a solenoid manifold 144 connected to the lower part 60 of the housing 18 of the printhead assembly 14, as shown in FIG. 7. The solenoid manifold 144 provides a connection for the ink lines and electrical wires.

The short ink supply line 104 includes two check valves, the first 146 located upstream of the purge line 134 and the second 148 located downstream of the purge line (FIG. 6). The upstream check valve 146 is provided to prevent ink from flowing from the purge line 134 into the reservoir 92 of the secondary ink supply 20 during a purge cycle. The downstream check valve 148 is provided to prevent back flow of ink or air from the printhead 16 into the short ink supply line 104.

As noted above, the controller 130 of each printhead assembly interfaces with the electronic controller 40 of the ink jet printing system for operation of the pump 22 upon receiving a low level signal from the level detector 102 of the secondary ink supply 20. An electrical schematic of the printhead controller 130 is provided in Attachment A. The printhead controller controls the purge shutoff valve 140 solenoid upon actuation of the purge switch 142 and controls the feed valve 124 solenoid upon receiving a low level signal from the level detector 102 of the secondary ink supply 20.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A piezoelectric ink jet printing system comprising a primary ink supply, a plurality of non-reciprocating piezoelectric ink jet printhead assemblies, each assembly comprising a housing, a piezoelectric ink jet printhead in the housing, a secondary ink supply attached to the housing adjacent the printhead, and an ink supply line for delivery of ink from the secondary ink supply to the printhead, the printhead of each printhead assembly comprising a linear array of ink orifices through which ink is ejected to print indicia on a surface, each printhead assembly further comprising a device for mounting the housing and printhead therein for rotation about a first axis extending generally perpendicular to said surface thereby to vary the height of the indicia printed on the surface by the printhead in the housing, and a device for locking the housing in a selected position of rotational adjustment according to the desired height of indicia to be printed, and the secondary ink supply of each printhead assembly being rotatably mounted with respect to the housing of the assembly so that when the housing of the printhead assembly is rotated in one direction about said first axis, the secondary ink supply may be rotated in an opposite direction to maintain the secondary ink supply in a selected predetermined attitude.

2. A system as set forth in claim 1 wherein the secondary ink supply of each printhead assembly is rotatable with respect to the housing about a second axis which passes adjacent to the lowest ink orifice in the linear array of orifices of the printhead of said assembly.

3. A printing system as set forth in claim 2 wherein said secondary ink supply of each printhead assembly is mounted in the housing of the printhead assembly adjacent said printhead.

* * * * *